US006564944B2

(12) United States Patent
Weder

(10) Patent No.: US 6,564,944 B2
(45) Date of Patent: May 20, 2003

(54) SHIPPING DEVICE WITH BONDABLE CUSHION LAYER

(75) Inventor: Donald E. Weder, Highland, IL (US)

(73) Assignee: Southpac Trust Inc'ln Inc.

( * ) Notice: Subject to any disclaimer, the term of this patent is extended or adjusted under 35 U.S.C. 154(b) by 0 days.

(21) Appl. No.: 10/046,810

(22) Filed: Jan. 15, 2002

(65) Prior Publication Data

US 2002/0060165 A1 May 23, 2002

Related U.S. Application Data

(63) Continuation of application No. 09/654,062, filed on Sep. 1, 2000, which is a continuation of application No. 09/229,560, filed on Jan. 13, 1999, now abandoned, which is a continuation of application No. 08/933,451, filed on Sep. 18, 1997, now Pat. No. 5,860,524, which is a continuation-in-part of application No. 08/796,489, filed on Feb. 5, 1997, now Pat. No. 5,836,448.

(51) Int. Cl.[7] ..... B65D 85/50
(52) U.S. Cl. ..... 206/423; 206/460
(58) Field of Search ..... 206/423, 460, 206/813, 523, 499; 53/475, 473, 443, 441, 446, 157, 445

(56) References Cited

U.S. PATENT DOCUMENTS

| | | | |
|---|---|---|---|
| 1,064,813 | A | 6/1913 | Bloomberg |
| 2,165,539 | A | 7/1939 | Dahlgren |
| 2,373,634 | A | 4/1945 | Wagner |
| 2,578,583 | A | 12/1951 | O'Brien |
| 2,664,670 | A | 1/1954 | Mulford |
| 2,707,352 | A | 5/1955 | Fischer |
| 2,721,022 | A | 10/1955 | Billerbeck |
| 2,744,624 | A | 5/1956 | Hoogstoel et al. |
| 2,871,080 | A | 1/1959 | Shelly |
| 2,887,220 | A | 5/1959 | Hankus |
| 3,113,673 | A | 12/1963 | Stein |
| 3,322,323 | A | 5/1967 | Green et al. |
| 3,374,884 | A | 3/1968 | Chinkes |
| 3,389,784 | A | 6/1968 | Hendricks et al. |
| 3,466,214 | A | 9/1969 | Polk et al. |
| 3,488,022 | A | 1/1970 | Vittori |
| 3,524,583 | A | 8/1970 | Gregory |
| 3,708,946 | A | 1/1973 | Cahill |
| 3,725,188 | A | 4/1973 | Kalt |
| 3,734,280 | A | 5/1973 | Amneus et al. |
| 3,754,642 | A | 8/1973 | Stidolph |
| 3,883,990 | A | 5/1975 | Stidolph |
| 3,924,354 | A | 12/1975 | Gregoire |
| 4,053,049 | A | 10/1977 | Beauvais |
| 4,170,301 | A | 10/1979 | Jones et al. |

(List continued on next page.)

FOREIGN PATENT DOCUMENTS

| | | |
|---|---|---|
| AT | 192843 | 11/1957 |
| DE | 2735225 | 4/1978 |
| EP | 686577 | 12/1995 |
| FR | 2221936 | 10/1974 |
| FR | 2496062 | 6/1982 |
| GB | 26878 | of 1913 |
| GB | 432899 | 8/1935 |
| JP | 4352664 | 12/1992 |
| JP | 61058 | 7/2000 |
| NL | 8101464 | 3/1981 |

OTHER PUBLICATIONS

Oasis Grower Products; Smithers–Oasis; Kent, OH; 1991.
"The Museum Putty" brochure "Is Your Home a "Museum" of Collectibles?", 3 pages, Aug. 2, 1993.

*Primary Examiner*—Shian Luong
(74) *Attorney, Agent, or Firm*—Dunlap Codding & Rogers

(57) ABSTRACT

A method and apparatus for preparing an item or plurality of items for shipment. Disposing one or a plurality of items on a rigid surface having a layer of deformable cushioning material with a bonding material thereon wherein the items are connectingly bonded to the foam layer which is deformed in response to the items. The items may be items of china, floral containers, and flower pots, or other similar items.

11 Claims, 2 Drawing Sheets

U.S. PATENT DOCUMENTS

| | | | |
|---|---|---|---|
| 4,248,347 | A | 2/1981 | Trimbee |
| 4,396,120 | A | 8/1983 | Morita |
| 4,470,508 | A | 9/1984 | Yen |
| 4,682,691 | A | 7/1987 | Spiering |
| 5,065,922 | A | 11/1991 | Harris |
| 5,092,465 | A | 3/1992 | Weder et al. |
| 5,111,638 | A | 5/1992 | Weder |
| 5,148,918 | A | 9/1992 | Weder et al. |
| 5,195,637 | A | 3/1993 | Weder |
| 5,240,109 | A | 8/1993 | Weder et al. |
| 5,255,784 | A | 10/1993 | Weder et al. |
| 5,311,992 | A | 5/1994 | Weder et al. |
| 5,322,181 | A | 6/1994 | Nelson |
| 5,407,072 | A | 4/1995 | Weder et al. |
| 5,411,137 | A | 5/1995 | Weder et al. |
| 5,522,205 | A | 6/1996 | Weder |
| 5,564,567 | A | 10/1996 | Weder |
| 5,584,392 | A | 12/1996 | Weder et al. |
| 5,697,199 | A | 12/1997 | Weder |
| 5,836,448 | A | 11/1998 | Weder |
| 5,860,524 | A | 1/1999 | Weder |

SHIPPING DEVICE WITH BONDABLE CUSHION LAYER

CROSS REFERENCE TO RELATED APPLICATIONS

This application is a continuation of U.S. Ser. No. 09/654,062, filed on Sep. 1, 2000; which is a continuation of U.S. Ser. No. 09/229,560, filed on Jan. 13, 1999, now abandoned; which is a continuation of U.S. Ser. No. 08/933,451, filed on Sep. 18, 1997, now U.S. Pat. No. 5,860,524; which is continuation-in-part of U.S. Ser. No. 08/796,489, filed on Feb. 5, 1997, now U.S. Pat. No. 5,836,448.

STATEMENT REGARDING FEDERALLY SPONSORED RESEARCH OR DEVELOPMENT

Not Applicable

BACKGROUND

The present invention is related to methods for transporting various items such as floral containers and china, wherein the items are bondingly connected to a surface having a bonding layer thereon for minimizing movement and disturbance of the items during transportation.

DESCRIPTION OF THE PREFERRED EMBODIMENTS

Figure 1:
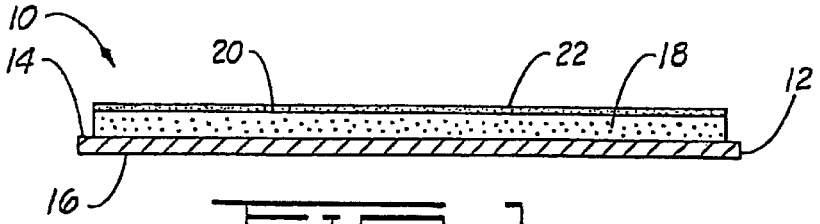
FIG. 1 is a cross-sectional view of a shipping device constructed for use in accordance with the present invention.

Shown in FIG. 1 and designated by the general reference numeral 10 is a shipping device constructed in accordance with the present invention. The shipping device 10 comprises a rigid or semi-rigid support member 12 which has an upper surface 14 and a lower surface 16. A layer of cushioning material 18 is connected to the upper surface 14 of the support member 12. In a preferred embodiment the cushioning material 18 is a foam layer 18. In another version, the cushioning material comprises a sheet of bubble wrap attached to the support member 12. Bubble wrap is commercially available in many sizes and is well known to a person of ordinary skill in the art. The cushioning material 18 has a substantially planar, non-corrugated upper surface 20. In a preferred version of the invention, a layer of connecting bonding material 22 is disposed upon the upper surface 20 of the cushioning material 18. When the cushioning material 18 is a foam layer, the bonding material 22 is generally not a completely discrete layer but at least partially infiltrates into an upper portion of the foam layer 18, and may extend well into the foam layer 18. The items contained within the shipping container are rendered substantially immobile upon the shipping device 10, and may be further cushioned, protected, or immobilized by packing material (not shown). Such packing materials are well known to those of ordinary skill in the art. In an alternate embodiment, the bonding material 22 may be dispersed throughout the cells of the foam comprising the foam layer 18 so there is not a discrete layer of bonding material which comprises the connecting bonding material 22. Included in this alternative embodiment are versions of foam which have inherently adhesive properties. The foam layer 18 may be disposed upon only a portion of the upper surface 14 of the support member 12, or upon the entire support member 12.

The support member 12 may be any shape which functions in accordance with the present invention. The support member 12, may, for example, be square, rectangular, circular or any other geometric shape which enhances the function of the support member 12 for the purpose disclosed herein. The support member 12 may be cardboard, wood, metal, plastic, resin, or any rigid or semi-rigid material, including a laminate of such material. The support member 12 may be the bed of a truck. Any thickness of the support member 12 may be utilized in accordance with the present invention as long as the support member 12 functions to support the objects disposed thereupon.

The object supported by the shipping device 10 may be china, a vase, a flower pot or a growing tray containing a floral grouping. As used herein, the term china includes everyday dishes, cups, plates, bowls, vases, trays, pitchers and other similar household table items and may be made from plastic, ceramic, glass, metal, porcelain or other materials used to manufacture such items. Vase or flower pot or growing tray refers to any type of container used for holding the floral grouping or single floral cuttings. In a preferred embodiment only a single vase or flower pot with a floral grouping therein is disposed on the shipping device 10, the bonding material 22 comprising the only substantial means of maintaining the vase or flower pot in an upright orientation. "Floral grouping" as used herein means cut fresh flowers, artificial flowers, a single flower either fresh and/or artificial plants or other floral materials and may include other secondary plants and/or ornamentation or artificial or natural materials which add to the aesthetics of the overall floral arrangement. The floral grouping generally comprises a bloom or foliage portion and a stem portion. However, it will be appreciated that the floral grouping may consist of only a single bloom or only foliage (not shown). The term "floral grouping" may be used interchangeably herein with the term "floral arrangement".

As used herein the term "foam" means a three-dimensional porous material having a reticulated configuration in cross section and which is pliable and conformable. Examples of foams are open cell polyurethane foams, PVA foam, and Hypol foam. Preferably the foam has a relatively consistent density and thickness. Preferably the foam layer is from about ⅛ to ¼ inches thick. An optimal thickness is 3⁄16 inches. Foam materials which may be used in the present invention are commercially available from various sources, such as that sold under the designation SIFZ Felted foam #2 obtainable from Foamex, Inc.; Crest Felted S-90Z, firmness 2 polyurethane foam distributed by Great Western; a microcellular hydrophilic polyurethane manufactured by Time Release Science and distributed by Truly Magic Products Inc.; PVA foam E-1 or E-2 distributed by Rippey Corp.; Hypol foam (2002, 2000, or 3000) produced by Hampshire Chemical Inc.; Acquell and hydrophilic foam manufactured by Foamex Foam Inc., #T70 foam produced by Crown Product Corp., and Bio-Foam available from Smithers Bio-Medical Systems of Kent, Ohio. Deformable styrofoams may also be used.

An example of a bonding material which may be applied to the upper surface 20 of the cushioning material 18 is Adhesive #9211 available from Dyna-Tech Adhesives of Grafton, W.V. As will be readily appreciated by one of ordinary skill in the art, any number of adhesive or cohesive bonding materials are commercially available which would function in accordance with the present invention, as long as they adhere to the cushioning material 18 and to the object disposed thereon.

The term "bonding material or bonding means" when used herein means an adhesive, frequently a pressure sensitive adhesive, or a cohesive or any other bonding material which functions as a bonding material in accordance with the invention described herein. When the bonding material is a cohesive, a similar cohesive material must be present on a surface of the object which will be disposed on the bonding surface of the shipping device. Preferably, when the bonding material is an adhesive, the cohesive forces between adhesive molecules within the foam are stronger than the adhesive forces between the adhesive and the item placed thereon so that when the item is removed from the foam a minimum of adhesive is left on the item.

Figure 2:
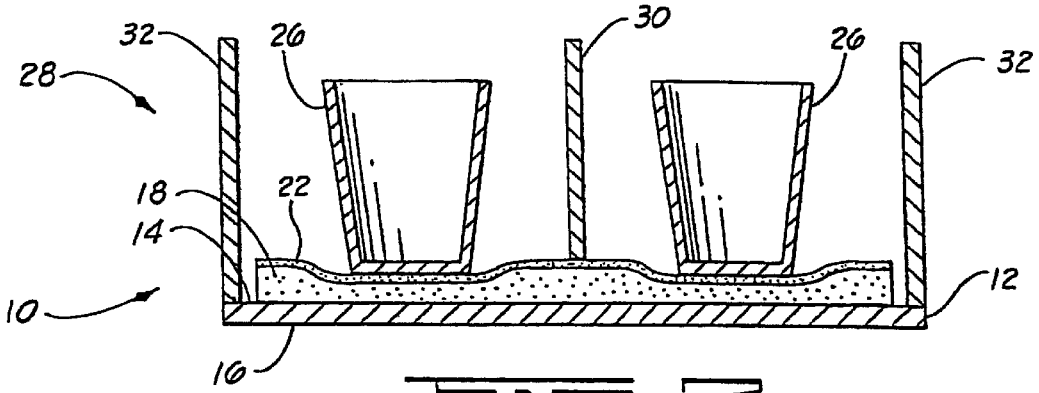
FIG. 2 is a cross-sectional view of a shipping assembly constructed in accordance with the present invention.

Shown in FIG. 2 is a plurality of containers 26 bondingly connected to the shipping device 10 via the connecting bonding material 22 disposed on the cushioning material 18 which is shown as a foam layer. The containers 26 and the shipping device 10 together constitute a shipping assembly 28 which may be used to ship the containers 26 to a predetermined location. Each container 26 is anchored or secured to the shipping device 10 via the bonding material 22 and is cushioned and stabilized by the foam layer 18. When the container 26 is placed upon the shipping device 10, the container 26 deforms a portion of the foam layer 18 upon which the container 26 rests, as indicated in FIG. 2. The foam layer 18 (or any other cushioning material contemplated herein) thereby at least partially conforms to the shape of the container 26 for enhancing the bonding connection between the foam layer 18 and the container 26. Preferably the cushioning layer 18 (in this case, the foam layer 18), returns to its original shape when the container 26 is removed from the foam layer 18 after shipping. It will be appreciated by one of ordinary skill in the art that the container shape displayed herein is but one of the great variety of shapes of objects, items or containers which may be used in accordance with the present invention. The bonding material 22 may be disposed on all of or only a portion of the upper surface of the foam layer 18. The bonding material 22 may have a release layer disposed thereon for maintaining the bonding properties of the bonding material and is removed prior to use of the device 10.

Also shown in the shipping assembly 28 in FIG. 2 is an optional partition 30 (also referred to as an insert) which is disposed between or over the objects disposed upon the shipping device. Also shown in the shipping assembly 28 in FIG. 2 are optional sidewalls 32 which extend vertically from the support member 12 surrounding the foam layer 18 and which at least partially enclose a space within which the containers reside. The shipping assembly 26 may further comprise a lid (not shown). Although the foam layer 18 is indicated in FIGS. 1–2 as comprising a continuous layer, the foam layer 18 may instead be disposed upon the support member 12 in any functional geometric form or pattern including spots, designs, strips, or squares.

The term "floral grouping" when used herein generally means a plant having a bloom portion and a stem portion. Further, the floral grouping 34 may comprise a root portion (not shown) as well. However, it will be appreciated that the floral grouping may consist of only a single bloom or only foliage, or a botanical item (not shown), or a propagule (not shown). The term "floral grouping" may also be used interchangeably herein with the terms "botanical item" and/or "propagule" and may include a plant having only foliage and no blooms.

The term "growing medium" when used herein means any liquid, solid or gaseous material used for plant growth or for the cultivation of propagules, including organic and inorganic materials such as soil, humus, perlite, vermiculite, sand, water and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

Figure 3:
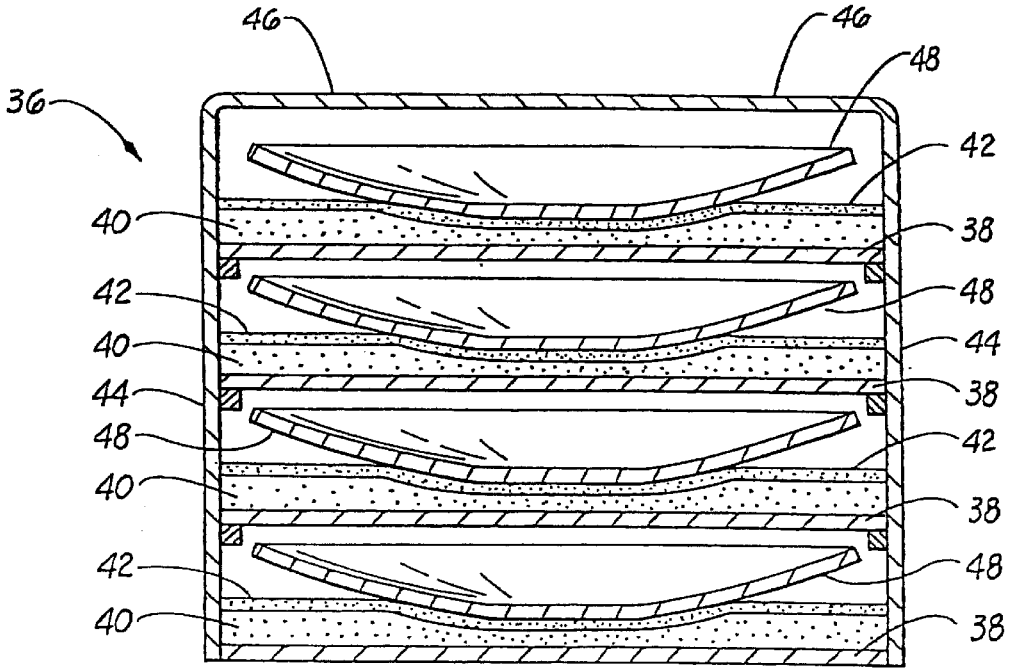
FIG. 3 is a cross-sectional view of another shipping assembly constructed in accordance with the present invention.

An alternative version of the present invention, shown in FIG. 3, is a shipping assembly designated by the general reference numeral 36. The shipping assembly 36 has a plurality of interior support surfaces 38, each having a cushioning material 40 exactly the same as described above and each having a connecting bonding material 42 disposed thereon. The assembly 36 may comprise a plurality of side walls 44 and upper flaps 46 which are shown in FIG. 3 in a closed position but when lifted in an outward direction can be opened into an open position. Each support surface 38 holds at least one item 48, as described earlier; the item 48 disposed on the cushioning material 40 and connected thereto via the bonding material 42, exactly as described above for the shipping assembly 28. The cushioning material 40 may be a foam layer or bubble layer as noted elsewhere herein.

Figure 4:
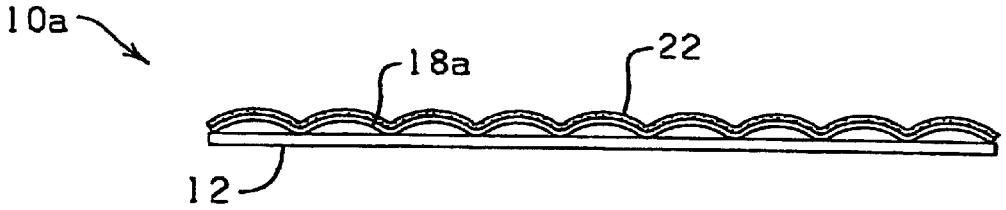
FIG. 4 is a cross-sectional view of another version of the present invention.
Figure 5:
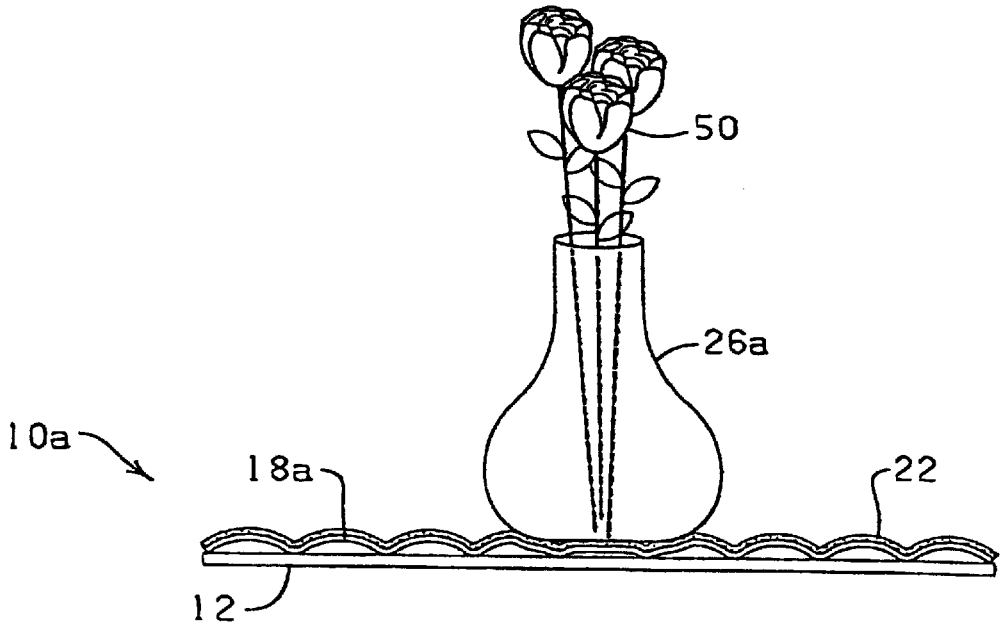
FIG. 5 is a cross-sectional view of the assembly of FIG. 4 having a floral container disposed thereon.

Shown in FIG. 4 is an alternate preferred version of the invention. Designated by the general reference numeral **10*a* is a shipping device exactly the same as that shown in FIG. 1 except the cushioning material 18*a* is a bubble wrap material. The bubble wrap 18*a* is attached to the support member 12, as above, and has a bonding material 22 disposed thereon. In use, as shown in FIG. 5, a floral container such as a vase or flower pot 26*a*, preferably having a floral grouping 50 disposed therein, is disposed upon the bubble wrap 18*a*, and is connected thereto via the bonding material 22. The vase or flower pot 26*a* deforms a portion of the bubble wrap 18*a* as shown in FIG. 5, thereby eliciting a cushioning effect from the bubble wrap 18*a*. The vase or flower pot 26*a* is thereby anchored or secured to the support member 12, in a generally upright orientation for shipment or transport. The cushioning material may comprise any deformable material known to persons of ordinary skill in the floral arts which functions in accordance with the present invention. The bonding material may be disposed on all, or only a portion, of the upper surface of the bubble wrap 18*a***.

When constructing the shipping devices embodied herein, it is preferable that when the support member 12 is a cardboard or other material which may be warped by wetness, the adhesive material which is used to connect the lower surface of the cushioning material to the support member 12 is placed first on the lower surface of the cushioning material (rather than to the support member 12) before the cushioning material is applied to the support member 12.

Changes may be made in the construction and the operation of the various components, elements and assemblies described herein or in the steps or the sequence of steps of the methods described herein without departing from the spirit and scope of the invention as defined in the following claims.

What is claimed is:

1. A method of packaging a floral grouping contained in a floral container for shipment, comprising:

providing a shipping device comprising:

a substantially rigid support member having a support surface;

a deformable cushioning material disposed on and connected to at least a portion of the support surface, the deformable cushioning material having a substantially planar, non-corrugated upper surface; and a bonding material disposed on at least a portion of the substantially planar, non-corrugated upper surface of the cushioning material of the cushioning material;

placing the floral container with the floral grouping contained therein in a substantially upright position on the substantially planar, non-corrugated upper surface of the cushioning material; and bondingly connecting the floral container to the deformable cushioning material such that the floral container having the floral grouping disposed therein is secured in a stable, upright position during shipment of the shipping device.

2. The method of claim 1 wherein the bonding material on the layer of deformable cushioning material is a pressure sensitive adhesive.

3. The method of claim 1 further comprising providing the floral container with a bonding material upon a portion thereof for cooperating with the bonding material of the deformable cushioning material to bondingly connect the floral container to the deformable cushioning material.

4. The method of claim 3 wherein the bonding material of the layer of deformable cushioning material and the bonding material of the floral container are cohesive materials.

5. The method of claim 1 wherein in the step of providing the shipping device, the shipping device further comprises a plurality of side walls attached to the support member and surrounding the layer of deformable cushioning material.

6. The method of claim 1 further comprising the step of transporting the shipping device and the floral container secured thereto to a predetermined destination.

7. A shipping assembly, comprising:

a shipping device comprising:

a substantially rigid support member having a support surface;

a deformable cushioning material disposed on and connected to at least a portion of the support surface, the deformable cushioning material having a substantially planar, non-corrugated upper surface; and a bonding material disposed on at least a portion of the substantially planar, non-corrugated upper surface of the cushioning material;

at least one floral container having a floral grouping contained therein placed in a substantially upright position on the substantially planar, non-corrugated upper surface of the deformable cushioning material and bondingly connected to the deformable cushioning material such that the floral container having the floral grouping disposed therein is secured in a stable, upright position during shipment of the shipping device.

8. The shipping device of claim 7 wherein the bonding material on the layer of deformable cushioning material is a pressure sensitive adhesive.

9. The shipping assembly of claim 7 wherein the floral container comprises a bonding material disposed thereon for cooperating with the bonding material of the deformable cushioning material to bondingly connect the floral container to the deformable cushioning material.

10. The shipping assembly of claim 9 wherein the bonding material of the layer of deformable cushioning material and the bonding material of the floral container are cohesive materials.

11. The shipping assembly of claim 7 wherein the support surface is constructed from the group consisting of cardboard, wood, metal, glass, plastic, thermoplastics, fiberglass, and resins.

* * * * *